US010847292B2

(12) United States Patent
Yoshidome et al.

(10) Patent No.: US 10,847,292 B2
(45) Date of Patent: Nov. 24, 2020

(54) SOFT MAGNETIC ALLOY AND MAGNETIC DEVICE

(71) Applicant: TDK CORPORATION, Tokyo (JP)

(72) Inventors: Kazuhiro Yoshidome, Tokyo (JP); Akito Hasegawa, Tokyo (JP); Hiroyuki Matsumoto, Tokyo (JP); Kenji Horino, Tokyo (JP); Akihiro Harada, Tokyo (JP); Syota Goto, Tokyo (JP); Isao Nakahata, Tokyo (JP)

(73) Assignee: TDK CORPORATION, Tokyo (JP)

( * ) Notice: Subject to any disclaimer, the term of this patent is extended or adjusted under 35 U.S.C. 154(b) by 250 days.

(21) Appl. No.: 16/055,536

(22) Filed: Aug. 6, 2018

(65) Prior Publication Data

US 2019/0043646 A1 Feb. 7, 2019

(30) Foreign Application Priority Data

Aug. 7, 2017 (JP) ..... 2017-152682
Feb. 26, 2018 (JP) ..... 2018-032183
Jul. 30, 2018 (JP) ..... 2018-142854

(51) Int. Cl.
*C22C 38/02* (2006.01)
*H01F 1/153* (2006.01)
(Continued)

(52) U.S. Cl.
CPC ..... *H01F 1/15333* (2013.01); *C22C 33/0257* (2013.01); *C22C 38/002* (2013.01); *C22C 38/004* (2013.01); *C22C 38/02* (2013.01); *C22C 38/12* (2013.01); *C22C 38/14* (2013.01); *C22C 38/16* (2013.01); *C22C 38/20* (2013.01); *C22C 38/26* (2013.01); *C22C 38/32* (2013.01); *C22C 45/02* (2013.01); *H01F 1/15308* (2013.01);
(Continued)

(58) Field of Classification Search
CPC . C22C 2200/02; C22C 2202/02; C22C 38/02; C22C 38/26; C22C 45/02; H01F 1/15308; H01F 1/15333; H01F 41/0226
USPC ..... 148/304
See application file for complete search history.

(56) References Cited

U.S. PATENT DOCUMENTS

2009/0266448 A1 10/2009 Ohta et al.
2010/0097171 A1 4/2010 Urata et al.
(Continued)

FOREIGN PATENT DOCUMENTS

JP 3342767 B2 11/2002
JP 2003-041354 A 2/2003
JP 5664934 B2 2/2015

*Primary Examiner* — Jie Yang
(74) *Attorney, Agent, or Firm* — Oliff PLC

(57) ABSTRACT

A soft magnetic alloy is composed of a Fe-based nanocrystal and an amorphous phase. In the soft magnetic alloy, S2-S1>0 is satisfied, where S1 (at %) denotes an average content rate of Si in the Fe-based nanocrystal and S2 (at %) denotes an average content rate of Si in the amorphous phase. In addition, the soft magnetic alloy has a composition formula of $((Fe_{(1-(\alpha+\beta))}X1_{\alpha}X2_{\beta})_{(1-(a+b+c+d+e+f))}M_aB_bSi_cP_dCr_eCu_f)_{1-g}C_g$. X1 is one or more selected from the group consisting of Co and Ni, X2 is one or more selected from the group consisting of Al, Mn, Ag, Zn, Sn, As, Sb, Bi, N, O, S and a rare earth element, and M is one or more selected from the group consisting of Nb, Hf, Zr, Ta, Ti, Mo, V and W. In the composition formula, a to g, α and β are in specific ranges.

16 Claims, 1 Drawing Sheet

(51) Int. Cl.

| | |
|---|---|
| ***C22C 38/32*** | (2006.01) |
| ***C22C 38/26*** | (2006.01) |
| ***C22C 38/00*** | (2006.01) |
| ***C22C 38/14*** | (2006.01) |
| ***C22C 38/16*** | (2006.01) |
| ***C22C 38/20*** | (2006.01) |
| ***C22C 33/02*** | (2006.01) |
| ***C22C 38/12*** | (2006.01) |
| ***C22C 45/02*** | (2006.01) |
| *H01F 41/02* | (2006.01) |

(52) U.S. Cl.
CPC ..... *C22C 2200/02* (2013.01); *C22C 2202/02* (2013.01); *H01F 41/0226* (2013.01)

(56) References Cited

U.S. PATENT DOCUMENTS

| | | | | |
|---|---|---|---|---|
| 2011/0085931 | A1 | 4/2011 | Ohta et al. | |
| 2011/0108167 | A1 | 5/2011 | Ohta et al. | |
| 2012/0318412 | A1* | 12/2012 | Ohta | C21D 8/1211 148/548 |
| 2019/0221341 | A1* | 7/2019 | Yoshidome | C22C 45/02 |
| 2019/0279799 | A1* | 9/2019 | Hosono | H01F 1/15383 |
| 2020/0135369 | A1* | 4/2020 | Yoshidome | H01F 1/15333 |

* cited by examiner

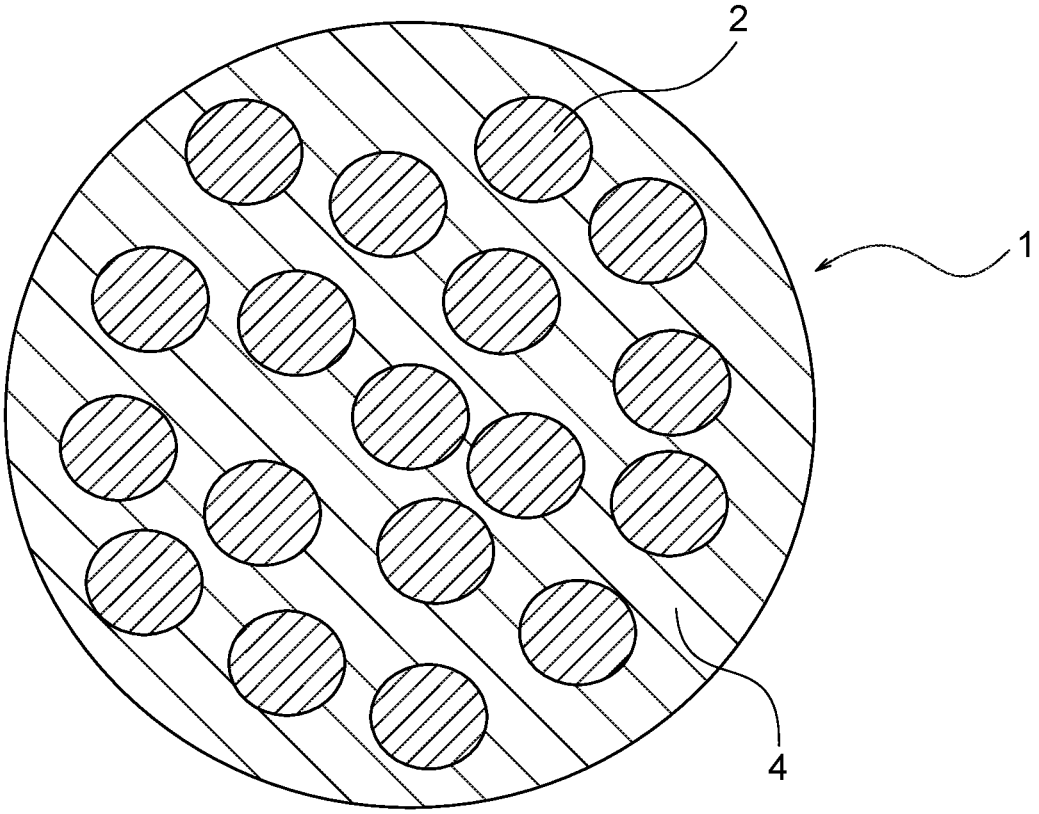
2
1
4

SOFT MAGNETIC ALLOY AND MAGNETIC DEVICE

BACKGROUND OF THE INVENTION

1. Field of the Invention

The present invention relates to a soft magnetic alloy and a magnetic device.

2. Description of the Related Art

Recently, for electronic, information, and communication devices and the like, lower power consumption and higher efficiency are demanded. Furthermore, such demands are even more demanded for a low-carbon society. Hence, a reduction of an energy loss and an improvement in power supply efficiency are demanded also for power supply circuits of electronic, information, and communication devices and the like. Moreover, for a magnetic core of a ceramic element to be used in the power supply circuit, an improvement in saturation magnetic flux density and a reduction of a core loss (magnetic core loss) are demanded. The loss of electric power energy decreases as the core loss decreases, and thus a higher efficiency is attained and energy is saved.

Patent document 1 describes an invention of a Fe-M-B based soft magnetic alloy in which fine crystal grains are deposited by a heat treatment. Patent Document 2 describes an invention of a Fe—Cu—B based soft magnetic alloy which contains crystal grains having a body-centered cubic structure and a small average grain size of 60 nm or less.

CITATION LIST

Patent Document

[Patent document 1]JP 2003-41354 A
[Patent document 2]JP 5664934 B2

SUMMARY OF THE INVENTION

Note that, it is conceivable to decrease the coercivity of the magnetic material constituting the magnetic core as a method for reducing the core loss of a magnetic core.

However, the soft magnetic alloy of the patent document 1 does not have a sufficiently high saturation magnetic flux density. The soft magnetic alloy of the patent document 2 does not have a sufficiently low coercivity. In other words, neither of the soft magnetic alloys exhibits sufficient soft magnetic properties.

An object of the present invention is to provide a soft magnetic alloy and the like exhibiting excellent soft magnetic properties of a high saturation magnetic flux density and a low coercivity.

In order to attain the above object, the soft magnetic alloy according to the present invention contains Fe as a main component and Si, in which the soft magnetic alloy includes a Fe-based nanocrystal and an amorphous phase, S2−S1>0 is satisfied, where S1 (at %) denotes an average content rate of Si in the Fe-based nanocrystal and S2 (at %) denotes an average content rate of Si in the amorphous phase, and the soft magnetic alloy has a composition formula of $((Fe_{(1-(\alpha-\beta))}X1_{\alpha}X2_{\beta})_{(1-(a+b+c+d+e+f))}M_aB_bSi_cP_dCr_eCu_f)_{1-g}C_g$, where X1 is one or more selected from the group consisting of Co and Ni, X2 is one or more selected from the group consisting of Al, Mn, Ag, Zn, Sn, As, Sb, Bi, N, O, S and a rare earth element, M is one or more selected from the group consisting of Nb, Hf, Zr, Ta, Ti, Mo, V and W, and $0 \le a \le 0.14$ $0 \le b \le 0.20$ $0 \le c \le 0.17$ $0 \le d \le 0.15$ $0 \le e \le 0.040$ $0 \le f \le 0.030$ $0 \le g \le 0.030$ $\alpha \ge 0$ $\beta \ge 0$ $0 \le \alpha+\beta \le 0.50$.

With the features described above, the soft magnetic alloy according to the present invention exhibits excellent soft magnetic properties of a high saturation magnetic flux density and a low coercivity.

The soft magnetic alloy according to the present invention may satisfy $S2-S1 \ge 2.00$.

In the soft magnetic alloy according to the present invention, an average grain size of the Fe-based nanocrystals may be 5.0 nm or more and 30 nm or less.

The soft magnetic alloy according to the present invention may satisfy $0.73 \le 1-(a+b+c+d+e+f) \le 0.95$.

The soft magnetic alloy according to the present invention may satisfy $0 \le \alpha\{1-(a+b+c+d+e+f)\}(1-g) \le 0.40$.

The soft magnetic alloy according to the present invention may satisfy $\alpha=0$.

The soft magnetic alloy according to the present invention may satisfy $0 \le \beta\{1-(a+b+c+d+e+f)\}(1-g) \le 0.030$.

The soft magnetic alloy according to the present invention may satisfy that $\beta=0$.

The soft magnetic alloy according to the present invention may satisfy $\alpha=\beta=0$.

The soft magnetic alloy according to the present invention may be formed in a ribbon form.

The soft magnetic alloy according to the present invention may be formed in a powder form.

The magnetic device according to the present invention includes the soft magnetic alloy described above.

BRIEF DESCRIPTION OF THE DRAWINGS

FIG. 1 is a schematic cross-sectional view of a soft magnetic alloy according to the present embodiment.

DESCRIPTION OF THE PREFERRED EMBODIMENTS

Hereinafter, embodiments of the present invention will be described with reference to the drawings.

A soft magnetic alloy 1 according to the present embodiment is a soft magnetic alloy containing Fe as a main component and Si. Here, "to contain Fe as a main component" means that the content of Fe with respect to the entire soft magnetic alloy is 70 at % or more. In addition, the lower limit of the content of Si is not particularly limited, but the content of Si may be, for example, 0.1 at % or more.

The soft magnetic alloy 1 is composed of a Fe-based nanocrystal 2 and an amorphous phase 4 as illustrated in Figure.

The Fe-based nanocrystal 2 has a grain size of nano-order and the crystal structure of Fe is bcc (body-centered cubic structure). In the present embodiment, it is preferable that the average grain size of the Fe-based nanocrystals 2 is 5.0 nm or more and 30 nm or less. The soft magnetic alloy 1 composed of such a Fe-based nanocrystal 2 and the amorphous phase 4 has a higher saturation magnetic flux density and a lower coercivity as compared with a soft magnetic alloy composed only of the amorphous phase 4.

The presence of the Fe-based nanocrystal 2 in the soft magnetic alloy 1 and the average grain size of the Fe-based nanocrystals 2 can be confirmed by observation using a transmission electron microscope (TEM). For example, the presence or absence of the Fe-based nanocrystal 2 can be confirmed by observing the cross section of the soft magnetic alloy 1 at a magnification of $1.00\times10^5$ to $3.00\times10^5$. In addition, the average grain size of the Fe-based nanocrystals 2 can be calculated by visually measuring the grain sizes (circle equivalent diameter) of 100 or more Fe-based nanocrystals 2 and averaging the values measured. Furthermore, the fact that the crystal structure of Fe in the Fe-based nanocrystal 2 is bcc can be confirmed by X-ray diffraction measurement (XRD).

In addition, the abundance proportion of the Fe-based nanocrystals 2 in the soft magnetic alloy 1 is not particularly limited, but for example, the area occupied by the Fe-based nanocrystals 2 on the cross section of the soft magnetic alloy 1 is 25% to 80%.

Furthermore, in the soft magnetic alloy 1 according to the present embodiment, $S2-S1>0$ is satisfied, where S1 (at %) denotes the average content rate of Si in the Fe-based nanocrystal 2 and S2 (at %) denotes the average content rate of Si in the amorphous phase 4. In other words, in the soft magnetic alloy 1 according to the present embodiment, Si is present in the amorphous phase 4 in a greater amount than in the Fe-based nanocrystals 2.

The soft magnetic properties can be further improved as $S2-S1>0$ is satisfied. In other words, it is possible to improve the saturation magnetic flux density while maintaining the coercivity at the same level as compared with a case in which $S2-S1\leq0$ is satisfied even when the compositions are the same as each other. In other words, it is possible to improve the soft magnetic properties.

In the conventionally known soft magnetic alloy composed of Fe-based nanocrystals and an amorphous phase, $S2-S1\leq0$ is satisfied, that is, Si is present in the Fe-based nanocrystals in a greater amount than in the amorphous phase. The present inventors have found out that it is possible to improve the soft magnetic properties by improving the saturation magnetic flux density without changing the composition of the soft magnetic alloy 1 as Si is present in the amorphous phase 4 in a greater amount. In addition, in the present embodiment, it is more preferable that $S2-S1\geq2.00$ is satisfied.

The content rate of Si can be measured by using a three-dimensional atom probe (3DAP).

First, a needle-shaped sample of $\phi100$ nm×200 nm is prepared, and the element mapping of Fe is performed in 100 nm×200 nm×5 nm. In the element mapped image, it can be regarded that a portion having a high Fe concentration is the Fe-based nanocrystal 2 and a portion having a low Fe concentration is the amorphous phase 4. Next, the content rate of Si at the measured site can be measured by analyzing the composition of the Fe-based nanocrystal 2 in 5 nm×5 nm×5 nm. The average content rate S1 of Si can be calculated by measuring the content rate of Si at five places and averaging the values measured. In addition, the content rate of Si at the measured site can be measured by analyzing the composition of the amorphous phase 4 in 5 nm×5 nm×5 nm. The average content rate S2 of Si can be calculated by measuring the content rate of Si at five places and averaging the values measured.

The soft magnetic alloy 1 according to the present embodiment has a composition formula of $((Fe_{(1-(\alpha+\beta)})X1_{\alpha}X2_{\beta})_{(1-(a+b+c+d+e+f))}M_aB_bSi_cP_dCr_cCu_f)_{1-g}C_g$, where X1 is one or more selected from the group consisting of Co and Ni, X2 is one or more selected from the group consisting of Al, Mn, Ag, Zn, Sn, As, Sb, Bi, N, O, S and a rare earth element, M is one or more selected from the group consisting of Nb, Hf, Zr, Ta, Ti, Mo, V and W, and $0\leq a\leq0.14$ $0\leq b\leq0.20$ $0\leq c\leq0.17$ $0\leq d\leq0.15$ $0\leq e\leq0.040$ $0\leq f\leq0.030$ $0\leq g\leq0.030$ $\alpha\geq0$ $\beta\geq0$ $0\leq\alpha+\beta\leq0.50.$ In the above composition, it is not essential to contain elements other than Fe and Si. In addition, the B content (b) is preferably $0.028\leq b\leq0.20$. The Si content (c) is preferably $0.001\leq c\leq0.17$. The P content (d) is preferably $0\leq d\leq0.030$. The C content (g) is preferably $0\leq g\leq0.025$. In addition, X2 may be one or more selected from the group consisting of Al, Mn, Ag, Zn, Sn, As, Sb, Bi, N, O and a rare earth element.

There is no limit to a Fe content $(1-(a+b+c+d+e+f))$, but $0.73\leq1-(a+b+c+d+e+f)\leq0.95$ is preferably satisfied.

In the soft magnetic alloy according to the present embodiment, a part of Fe may be substituted with X1 and/or X2. X1 is one or more elements selected from a group of Co and Ni. A X1 content ($\alpha$) may satisfy $\alpha=0$. That is, X1 may not be contained. The number of atoms of X1 is preferably 40 at % or less provided that the number of atoms of an entire composition is 100 at %. That is, $0\leq\alpha\{1-(a+b+c+d+e+f)\}(1-g)\leq0.40$ is preferably satisfied.

X2 is one or more elements selected from a group of Al, Mn, Ag, Zn, Sn, As, Sb, Bi, N, O, S, and rare earth elements. A X2 content (($\beta$) may satisfy $\beta=0$. That is, X2 may not be contained. The number of atoms of X2 is preferably 3.0 at % or less provided that the number of atoms of an entire composition is 10 0 at %. That is, $0\leq\beta\{1-(a+b+c+d+e+f)\}(1-g)\leq0.030$ is preferably satisfied.

The substitution amount of Fe with X1 and/or X2 is half or less of Fe based on the number of atoms. That is, $0\leq\alpha+\beta<0.50$ is satisfied.

The soft magnetic alloy having the composition described above is likely to be a soft magnetic alloy which is composed of an amorphous phase and does not contain a crystal phase composed of crystals having a grain size larger than 15 nm. Moreover, the Fe-based nanocrystals are likely to be deposited in the case of subjecting the soft magnetic alloy to a heat treatment as to be described below. Moreover, the soft magnetic alloy composed of the Fe-based nanocrystal 2 and the amorphous phase 4 are likely to exhibit favorable soft magnetic properties.

In other words, the soft magnetic alloy having the composition described above tends to be a starting material of the soft magnetic alloy 1 deposited with the Fe-based nanocrystals 2.

Note that, the soft magnetic alloy before being subjected to a heat treatment may be completely composed only of an amorphous phase, but it is preferable that the soft magnetic alloy is composed of an amorphous phase and initial fine crystals having a grain size of 15 nm or less and has a nanohetero structure in which the initial fine crystals are present in the amorphous phase. The Fe-based nanocrystals 2 are likely to be deposited at the time of the heat treatment as the soft magnetic alloy has a nanohetero structure in which the initial fine crystals are present in the amorphous phase. Note that, in the present embodiment, it is preferable that the initial fine crystals have an average grain size of 0.3 to 10 nm.

Note that, the soft magnetic alloy 1 according to the present embodiment may contain elements other than the elements described above as inevitable impurities. For example, the inevitable impurities may be contained at 1 wt % or less with respect to 100 wt % of the soft magnetic alloy.

Hereinafter, a method of producing the soft magnetic alloy 1 according to the present embodiment will be described.

The method of producing the soft magnetic alloy according to the present embodiment is not particularly limited. For example, there is a method in which a ribbon of the soft magnetic alloy according to the present embodiment is produced by a single roll method. In addition, the ribbon may be a continuous ribbon.

In the single roll method, first, pure metals of the respective metal elements to be contained in the soft magnetic alloy to be finally obtained are prepared and weighed so as to have the same composition as that of the soft magnetic alloy to be finally obtained. Thereafter, the pure metals of the respective metal elements are melted and mixed together to prepare a base alloy. Note that, the method of melting the pure metals is not particularly limited, but for example, there is a method in which interior of the chamber is vacuumed and then the pure metals are melted in the chamber by high frequency heating. Note that, the base alloy and the soft magnetic alloy, which is finally obtained and composed of Fe-based nanocrystals, usually have the same composition as each other.

Next, the prepared base alloy is heated and melted to obtain a molten metal (melt). The temperature of the molten metal is not particularly limited, but it may be, for example, 1200° C. to 1500° C.

In the single roll method, it is possible to adjust the thickness of the ribbon to be obtained mainly by adjusting the rotating speed of a roll 33, but it is also possible to adjust the thickness of the ribbon to be obtained by adjusting, for example, the distance between the nozzle and the roll and the temperature of the molten metal. The thickness of the ribbon is not particularly limited, but it may be, for example, 5 to 30 μm.

At the time point before a heat treatment to be described later is performed, the ribbon is amorphous as it does not contain a crystal having a grain size larger than 15 nm. The Fe-based nanocrystalline alloy can be obtained by subjecting the amorphous ribbon to a heat treatment to be described later.

Note that, the method of confirming whether or not the ribbon of a soft magnetic alloy before being subjected to a heat treatment contains a crystal having a grain size larger than 15 nm is not particularly limited. For example, the presence or absence of a crystal having a grain size larger than 15 nm can be confirmed by usual X-ray diffraction measurement.

In addition, the ribbon before being subjected to a heat treatment may not contain the initial fine crystal having a grain size of less than 15 nm, but it is preferable to contain the initial fine crystal. In other words, it is preferable that the ribbon before being subjected to a heat treatment has a nanohetero structure composed of an amorphous phase and the initial fine crystal present in the amorphous phase. Note that, the grain size of the initial fine crystals is not particularly limited, but it is preferable that the average grain size thereof is in a range of 0.3 to 10 nm.

In addition, the methods of observing the presence or absence and average grain size of the initial fine crystals are not particularly limited, but for example, the presence or absence and average grain size of the initial fine crystals can be confirmed by obtaining a restricted visual field diffraction image, a nano beam diffraction image, a bright field image or a high resolution image of a sample thinned by ion milling by using a transmission electron microscope. In the case of using a restricted visual field diffraction image or a nano beam diffraction image, a ring-shaped diffraction is formed in a case in which the initial fine crystals are amorphous but diffraction spots due to the crystal structure are formed in a case in which the initial fine crystals are not amorphous in the diffraction pattern. In addition, in the case of using a bright field image or a high resolution image, the presence or absence and average grain size of the initial fine crystals can be confirmed by visual observation at a magnification of $1.00\times10^5$ to $3.00\times10^5$.

The temperature and rotating speed of the roll and the internal atmosphere of the chamber are not particularly limited. It is preferable to set the temperature of the roll to 4° C. to 30° C. for amorphization. The average grain size of the initial fine crystals tends to be smaller as the rotating speed of the roll is faster, and it is preferable to set the rotating speed to 25 to 30 m/sec in order to obtain initial fine crystals having an average grain size of 0.3 to 10 nm. The internal atmosphere of the chamber is preferably set to air atmosphere in consideration of cost.

In addition, the heat treatment conditions for producing the Fe-based nanocrystalline alloy are not particularly limited. Here, in the soft magnetic alloy according to the present embodiment, it is possible to control S1 and S2 described above and thus to achieve that $S2-S1>0$ particularly by controlling the heat treatment conditions. In addition, it is preferable to satisfy $S2-S1\geq1.07$ and it is more preferable to satisfy $S2-S\geq2.00$. In addition, there is no particular upper limit of $S2-S1$, but for example, it can be set that $S2-S1\leq10$ and it is preferable to satisfy $S2-S1\leq6.09$.

The heat treatment according to the present embodiment includes a heating step of heating the ribbon to a specific retention temperature, a retention step of maintaining the ribbon at the specific retention temperature, and a cooling step of cooling the ribbon from the specific retention temperature. Here, it can be achieved that $S2-S1>0$ by shortening the time required for achieving the specific retention temperature and a temperature close thereto than the conventional time. The time also changes depending on the composition of the soft magnetic alloy and the like, but specifically, it is likely to achieve that S2−S1>0 by setting the retention time in the retention step to 0 minute or more and less than 10 minutes, preferably 0 minute or more and 5 minutes or less, more preferably 0 minute or more and 1 minute or less. Note that, the retention time of 0 minute is synonymous with that cooling is started immediately after the temperature has reached the retention temperature by heating. In addition, preferable heat treatment conditions differ depending on the composition of the soft magnetic alloy. Usually, the preferable retention temperature is approximately 400° C. to 650° C.

Furthermore, the heating rate from 300° C. to the retention temperature in the heating step is set to preferably 250° C./min or more and still more preferably 500° C./min or more. In addition, the cooling rate from the retention temperature to 300° C. in the cooling step is set to preferably 20° C./min or more and still more preferably 40° C./min or more. The heating rate and cooling rate are also set to be in faster ranges than the conventional heating rate and cooling rate.

The present inventors consider that the reason why it can be achieved that S2−S1>0 by shortening the time required for achieving the specific retention temperature and a temperature close thereto in the heat treatment than the conventional time is as follows.

At the stage of generating the Fe-based nanocrystals by heating the soft magnetic alloy, Si is hardly contained in the Fe-based nanocrystals but likely to be contained in the amorphous phase in a greater amount. Here, it is considered that Si is in a more stable energy state when being contained in the Fe-based nanocrystals than when being contained in the amorphous phase. Moreover, after the Fe-based nanocrystals are generated, Si contained in the amorphous phase is solid dissolved into the Fe-based nanocrystals while the retention temperature and a temperature close thereto is maintained, and the Si content in the Fe-based nanocrystal becomes higher than the Si content in the amorphous phase.

Hence, S2−S1≤0 in the conventional soft magnetic alloy containing Fe-based nanocrystals. On the contrary, S2−S1>0 in the soft magnetic alloy according to the present embodiment since the time required for achieving the specific retention temperature and a temperature close thereto in the heat treatment is shortened than the conventional time as described above. Moreover, a soft magnetic alloy, which exhibits superior soft magnetic properties than the conventional soft magnetic alloy containing Fe-based nanocrystals, is obtained.

There is also a case in which preferable heat treatment conditions exist in a range deviated from the above range depending on the composition, but it is common to shorten the time required for achieving the specific retention temperature and a temperature close thereto in the heat treatment than the conventional time. In addition, the atmosphere at the time of the heat treatment is not particularly limited. The heat treatment may be performed in an active atmosphere such as air atmosphere or in an inert atmosphere such as Ar gas.

In addition, as a method of obtaining the soft magnetic alloy according to the present embodiment, for example, there is a method in which a powder of the soft magnetic alloy according to the present embodiment is obtained by a water atomizing method or a gas atomizing method other than the single roll method described above. The gas atomizing method will be described below.

In the gas atomizing method, a molten alloy at 1200° C. to 1500° C. is obtained in the same manner as in the single roll method described above. Thereafter, the molten alloy is sprayed into the chamber and a powder is prepared.

At this time, it is likely to obtain the preferable nanohetero structure described above by setting the gas spraying temperature to 4° C. to 30° C. and the vapor pressure in the chamber to 1 hPa or less.

For example, by performing the heat treatment at a retention temperature of 400° C. to 700° C., a heating rate of 20° C./min or more, and a cooling rate of 20° C./min or more for a retention time of 0 minute or more and less than 10 minutes after the powder has been prepared by the gas atomizing method, it is possible to promote the diffusion of elements while preventing the powders from being coarsened by sintering of the respective powders, to achieve the thermodynamical equilibrium state in a short time, and to remove distortion and stress and it is likely to obtain a Fe-based soft magnetic alloy having an average grain size of 10 to 50 nm. Furthermore, S2−S1>0 in the soft magnetic alloy.

An embodiment of the present invention has been described above, but the present invention is not limited to the above embodiment.

The shape of the soft magnetic alloy according to the present embodiment is not particularly limited. As described above, examples thereof may include a ribbon form and a powder form, but a block form and the like are also conceivable other than these.

The application of the soft magnetic alloy (Fe-based nanocrystalline alloy) according to the present embodiment is not particularly limited. For example, magnetic devices are mentioned, and particularly magnetic cores are mentioned among these. The soft magnetic alloy can be suitably used as a magnetic core for an inductor, particularly for a power inductor. The soft magnetic alloy according to the present embodiment can also be suitably used in thin film inductors and magnetic heads in addition to the magnetic cores.

Hereinafter, a method of obtaining a magnetic device, particularly a magnetic core and an inductor from the soft magnetic alloy according to the present embodiment will be described, but the method of obtaining a magnetic core and an inductor from the soft magnetic alloy according to the present embodiment is not limited to the following method. Further, examples of the application of the magnetic core may include transformers and motors in addition to the inductors.

Examples of a method of obtaining a magnetic core from a soft magnetic alloy of a ribbon form may include a method in which the soft magnetic alloy of the ribbon form is wound and a method in which the soft magnetic alloy of the ribbon form is laminated. It is possible to obtain a magnetic core exhibiting further improved properties in the case of laminating the soft magnetic alloy of the ribbon form via an insulator.

Examples of a method of obtaining a magnetic core from a powdery soft magnetic alloy may include a method in which the powdery soft magnetic alloy is appropriately mixed with a binder and then molded by using a press mold. In addition, the specific resistance is improved and a magnetic core adapted to a higher frequency band is obtained by subjecting the powder surface to an oxidation treatment, an insulating coating, and the like before the powdery soft magnetic alloy is mixed with a binder.

The molding method is not particularly limited, and examples thereof may include molding using a press mold or mold molding. The kind of binder is not particularly limited, and examples thereof may include a silicone resin. The mixing ratio of a binder to the soft magnetic alloy powder is also not particularly limited. For example, a binder is mixed at 1 to 10 mass % with respect to 100 mass % of the soft magnetic alloy powder.

It is possible to obtain a magnetic core having a space factor (powder filling rate) of 70% or more, a magnetic flux density of 0.45 T or more when a magnetic field of $1.6\times10^4$ A/m is applied, and a specific resistance of 1 Å·cm or more, for example, by mixing a binder at 1 to 5 mass % with respect to 100 mass % of the soft magnetic alloy powder and performing compression molding of the mixture using a press mold. The above properties are equal or superior to those of a general ferrite core.

In addition, it is possible to obtain a dust core having a space factor of 80% or more, a magnetic flux density of 0.9 T or more when a magnetic field of $1.6\times10^4$ A/m is applied, and a specific resistance of 0.1 Å·cm or more, for example, by mixing a binder at 1 to 3 mass % with respect to 100 mass % of the soft magnetic alloy powder and performing compression molding of the mixture using a press mold under a temperature condition of the softening point of the binder or more. The above properties are superior to those of a general dust core.

The core loss further decreases and the usability increases by further subjecting the molded body forming the magnetic core to a heat treatment as a distortion relief heat treatment after the molded body is molded. Note that, the core loss of the magnetic core decreases as the coercivity of the magnetic material constituting the magnetic core decreases.

In addition, an inductance component is obtained by subjecting the magnetic core to winding. The method of winding and the method of producing an inductance component are not particularly limited. For example, there is a method in which a coil is wound around the magnetic core produced by the method described above one or more turns.

Furthermore, in the case of using soft magnetic alloy grains, there is a method in which an inductance component is produced by compression-molding and integrating the magnetic material and the winding coil in a state in which the winding coil is incorporated in the magnetic material. In this case, it is easy to obtain an inductance component responding to a high frequency and a large current.

Furthermore, in the case of using soft magnetic alloy grains, it is possible to obtain an inductance component by alternately printing and laminating a soft magnetic alloy paste prepared by adding a binder and a solvent to soft magnetic alloy grains and pasting the mixture and a conductive paste prepared by adding a binder and a solvent to a conductive metal for a coil and pasting the mixture and then heating and firing the laminate. Alternatively, it is possible to obtain an inductance component in which a coil is incorporated in the magnetic material by preparing a soft magnetic alloy sheet using a soft magnetic alloy paste, printing a conductive paste on the surface of the soft magnetic alloy sheet, and laminating and firing these.

Here, in the case of producing an inductance component using soft magnetic alloy grains, it is preferable to use a soft magnetic alloy powder having a maximum grain size of 45 μm or less in terms of sieve size and a center grain size (D50) of 30 μm or less in order to obtain excellent Q properties. A sieve having a mesh size of 45 μm may be used and only the soft magnetic alloy powder passing through the sieve may be used in order to set the maximum grain size to 45 μm or less in terms of the sieve size.

The Q value tends to decrease in the high frequency region as the soft magnetic alloy powder having a larger maximum grain size is used, and there is a case in which the Q value in the high frequency region greatly decreases particularly in the case of using a soft magnetic alloy powder having a maximum grain size of more than 45 μm in terms of the sieve size. However, it is possible to use a soft magnetic alloy powder having a large deviation in a case in which the Q value in the high frequency region is not regarded as important. It is possible to cut down the cost in a case in which a soft magnetic alloy powder having a large deviation is used since the soft magnetic alloy powder having a large deviation can be produced at relatively low cost.

EXAMPLES

Hereinafter, the present invention will be specifically described based on Examples.

Experimental Example 1

Metal materials were weighed so as to obtain the alloy compositions of the respective Examples and Comparative Examples presented in the following table, and melted by high frequency heating, thereby preparing a base alloy.

Thereafter, the prepared base alloy was heated and melted to obtain molten metal at 1300° C., and then the metal was sprayed to a roll by a single roll method using a roll at 20° C. at the rotating speed presented in the following table in the air atmosphere, thereby preparing a ribbon. In Examples and Comparative Examples in which the rotating speed was not described, the rotating speed was set to 30 m/sec. The ribbon had a thickness of 20 to 25 μm, a width of about 15 mm, and a length of about 10 m.

The respective obtained ribbons were subjected to the X-ray diffraction measurement to confirm the presence or absence of crystals having a grain size larger than 15 nm. Thereafter, the ribbon was determined to be composed of an amorphous phase in a case in which a crystal having a grain size larger than 15 nm is not present and the ribbon was determined to be composed of a crystalline phase in a case in which a crystal having a grain size larger than 15 nm is present.

Thereafter, the ribbons of the respective Examples and Comparative Examples were subjected to a heat treatment under the conditions presented in the following Table 1. In the respective Examples and Comparative Examples, the heating rate from 300° C. to the heat treatment temperature, the heat treatment time, and the cooling rate from the heat treatment temperature to 300° C. are changed. At this time, the test was performed five times for each of Examples and Comparative Examples by changing the heat treatment temperature to five stages of 450° C., 500° C., 550° C., 600° C., and 650° C. Thereafter, the heat treatment temperature at which the coercivity was the lowest was taken as the optimum heat treatment temperature at the composition and under the heat treatment condition. The test results presented in the following Table 1 are the results of tests performed at the optimum heat treatment temperatures.

The crystal structure of each ribbon after being subjected to the heat treatment was confirmed by X-ray diffraction measurement (XRD) and observation using a transmission electron microscope (TEM). Thereafter, the average grain size of Fe-based nanocrystals having a bcc crystal structure in each ribbon was measured, and it was confirmed that the average grain size of Fe-based nanocrystals was 5.0 nm or more and 30 nm or less in all Examples and Comparative Examples. Furthermore, the average content rate S1 (at %) of Si in the Fe-based nanocrystals and the average content rate S2 (at %) of Si in the amorphous phase were measured by using a three-dimensional atom probe (3DAP).

Furthermore, the saturation magnetic flux density Bs and the coercivity Hc in the respective Examples and Comparative Examples were measured. The saturation magnetic flux density was measured by using a vibrating sample magnetometer (VSM) at a magnetic field of 1000 kA/m. The coercivity was measured by using a direct current BH tracer at a magnetic field of 5 kA/m. The results are presented in Table 1.

TABLE 1

| | | $(Fe_{(1-(a+b+c+d+e+f))}M_aB_bSi_cP_dCr_eCu_f)_{1-g}C_g$ ($\alpha = \beta = 0$) | | | | | | | | | | | | | | |
|---|---|---|---|---|---|---|---|---|---|---|---|---|---|---|---|---|
| | Sample No. | Fe | Nb | Hf | Zr | Ta | Ti a | Mo | V | W | B b | Si c | P d | Cr e | Cu f | C g |
| Example | 1a | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| | 1b | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| | 1c | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| | 1d | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| | 1e | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| Comparative | 5a | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| Example | 5b | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| | 5c | 0.840 | 0.070 | 0.000 | 0.000 | 0.000 | 0.000 | 0.000 | 0.000 | 0.000 | 0.080 | 0.010 | 0.000 | 0.000 | 0.000 | 0.000 |
| Example | 2a | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| | 2b | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| | 2c | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| | 2d | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| | 2e | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| Comparative | 6a | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| Example | 6b | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| | 6c | 0.840 | 0.070 | 0.000 | 0.000 | 0.000 | 0.000 | 0.000 | 0.000 | 0.000 | 0.080 | 0.010 | 0.000 | 0.000 | 0.000 | 0.005 |
| Example | 3a | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |
| | 3b | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |
| | 3c | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |
| | 3d | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |
| | 3e | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |
| Comparative | 7a | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |
| Example | 7b | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |
| | 7c | 0.878 | 0.000 | 0.000 | 0.000 | 0.000 | 0.000 | 0.000 | 0.000 | 0.000 | 0.091 | 0.020 | 0.010 | 0.000 | 0.001 | 0.010 |

| | | | Heat treatment conditions | | | | | | |
|---|---|---|---|---|---|---|---|---|---|
| | | Sample No. | Retention time (minutes) | Heating rate (° C./min) | Cooling rate (° C./min) | S1 (at %) | S2 (at %) | Bs (T) | Hc (A/m) |
| | Example | 1a | 1 | 250 | 40 | 0.21 | 5.25 | 1.73 | 4.3 |
| | | 1b | 5 | 250 | 40 | 0.56 | 3.20 | 1.71 | 5.3 |
| | | 1c | 1 | 100 | 40 | 0.42 | 4.21 | 1.72 | 4.8 |
| | | 1d | 1 | 250 | 20 | 1.80 | 2.10 | 1.71 | 5.8 |
| | | 1e | 1 | 500 | 40 | 0.10 | 6.21 | 1.74 | 4.0 |
| | Comparative | 5a | 60 | 250 | 40 | 3.20 | 0.80 | 1.68 | 8.2 |
| | Example | 5b | 10 | 40 | 40 | 3.10 | 0.74 | 1.65 | 9.2 |
| | | 5c | 1 | 250 | 10 | 2.10 | 1.65 | 1.69 | 8.1 |
| | Example | 2a | 1 | 250 | 40 | 0.13 | 5.32 | 1.75 | 4.1 |
| | | 2b | 5 | 250 | 40 | 0.48 | 3.13 | 1.74 | 5.1 |
| | | 2c | 1 | 100 | 40 | 0.41 | 4.31 | 1.73 | 4.7 |
| | | 2d | 1 | 250 | 20 | 0.92 | 1.23 | 1.71 | 5.9 |
| | | 2e | 1 | 500 | 40 | 0.14 | 6.22 | 1.75 | 3.8 |
| | Comparative | 6a | 60 | 250 | 40 | 2.30 | 0.67 | 1.69 | 8.3 |
| | Example | 6b | 10 | 40 | 40 | 3.20 | 0.57 | 1.66 | 9.4 |
| | | 6c | 1 | 250 | 10 | 2.40 | 1.63 | 1.65 | 9.2 |
| | Example | 3a | 1 | 250 | 40 | 0.45 | 6.23 | 1.85 | 4.5 |
| | | 3b | 5 | 250 | 40 | 0.56 | 4.21 | 1.82 | 4.2 |
| | | 3c | 1 | 100 | 40 | 1.23 | 3.21 | 1.82 | 4.8 |
| | | 3d | 1 | 250 | 20 | 1.82 | 3.21 | 1.81 | 5.3 |
| | | 3e | 1 | 500 | 40 | 0.23 | 6.88 | 1.86 | 4.2 |
| | Comparative | 7a | 60 | 250 | 40 | 4.23 | 0.83 | 1.81 | 7.2 |
| | Example | 7b | 10 | 40 | 40 | 5.21 | 0.34 | 1.81 | 8.3 |
| | | 7c | 1 | 250 | 10 | 4.82 | 0.56 | 1.83 | 10.3 |

As can be seen from Table 1, in Examples in which the retention time was controlled to be shorter than usual and the heating rate and the cooling rate were controlled to be faster than usual so that S2−S1>0, the soft magnetic properties were improved as compared with Comparative Examples in which S2−S1<0 although the compositions were the same as those in Examples.

Experimental Example 2

A soft magnetic alloy was prepared in the same manner as in Experimental Example 1 except that metal materials were weighed so as to obtain the alloy compositions of the respective Examples and Comparative Examples presented in the following table, the heat treatment temperature was set to 450° C. to 650° C., the heating rate from 300° C. to the heat treatment temperature was set to 250° C./min, the retention time was set to 1 minute, and the cooling rate from the heat treatment temperature to 300° C. was set to 40° C./min. Note that, in Experimental Example 2, a saturation magnetic flux density of 1.40 T or more was determined to be favorable and a coercivity of 7.0 A/m or less was determined to be favorable.

TABLE 2

| | | $(Fe_{(1-(a+b+c+d+e+f))}M_aB_bSi_cP_dCr_eCu_f)_{1-g}C_g$ ($\alpha = \beta = 0$) | | | | | | | | | | |
|---|---|---|---|---|---|---|---|---|---|---|---|---|
| | Sample No. | Fe | Nb | Hf | Zr | Ta | Ti | Mo | V | W | B | Si |
| | | | | | | a | | | | | b | c |
| Example | 9 | 0.875 | 0.000 | 0.000 | 0.030 | 0.000 | 0.000 | 0.000 | 0.000 | 0.000 | 0.090 | 0.005 |
| Example | 10 | 0.855 | 0.000 | 0.000 | 0.050 | 0.000 | 0.000 | 0.000 | 0.000 | 0.000 | 0.090 | 0.005 |
| Example | 11 | 0.835 | 0.000 | 0.000 | 0.070 | 0.000 | 0.000 | 0.000 | 0.000 | 0.000 | 0.090 | 0.005 |
| Example | 12 | 0.815 | 0.000 | 0.000 | 0.090 | 0.000 | 0.000 | 0.000 | 0.000 | 0.000 | 0.090 | 0.005 |
| Example | 13 | 0.795 | 0.000 | 0.000 | 0.110 | 0.000 | 0.000 | 0.000 | 0.000 | 0.000 | 0.090 | 0.005 |
| Example | 14 | 0.775 | 0.000 | 0.000 | 0.130 | 0.000 | 0.000 | 0.000 | 0.000 | 0.000 | 0.090 | 0.005 |

| | | $(Fe_{(1-(a+b+c+d+e+f))}M_aB_bSi_cP_dCr_eCu_f)_{1-g}C_g$ ($\alpha = \beta = 0$) | | | | S1 | S2 | | |
|---|---|---|---|---|---|---|---|---|---|
| | Sample No. | P d | Cr e | Cu f | C g | (at %) | (at %) | Bs (T) | Hc (A/m) |
| Example | 9 | 0.000 | 0.000 | 0.000 | 0.005 | 0.20 | 2.34 | 1.70 | 2.8 |
| Example | 10 | 0.000 | 0.000 | 0.000 | 0.005 | 0.18 | 2.56 | 1.67 | 2.6 |
| Example | 11 | 0.000 | 0.000 | 0.000 | 0.005 | 0.22 | 2.45 | 1.61 | 2.5 |
| Example | 12 | 0.000 | 0.000 | 0.000 | 0.005 | 0.24 | 2.47 | 1.57 | 2.8 |
| Example | 13 | 0.000 | 0.000 | 0.000 | 0.005 | 0.25 | 2.54 | 1.54 | 3.0 |
| Example | 14 | 0.000 | 0.000 | 0.000 | 0.005 | 0.24 | 2.53 | 1.51 | 3.1 |

TABLE 3

| | | $(Fe_{(1-(a+b+c+d+e+f))}M_aB_bSi_cP_dCr_eCu_f)_{1-g}C_g$ ($\alpha = \beta = 0$) | | | | | | | | | | |
|---|---|---|---|---|---|---|---|---|---|---|---|---|
| | Sample No. | Fe | Nb | Hf | Zr | Ta | Ti | Mo | V | W | B | Si |
| | | | | | | a | | | | | b | c |
| Example | 16 | 0.905 | 0.000 | 0.000 | 0.060 | 0.000 | 0.000 | 0.000 | 0.000 | 0.000 | 0.030 | 0.005 |
| Example | 17 | 0.885 | 0.000 | 0.000 | 0.060 | 0.000 | 0.000 | 0.000 | 0.000 | 0.000 | 0.050 | 0.005 |
| Example | 18 | 0.835 | 0.000 | 0.000 | 0.060 | 0.000 | 0.000 | 0.000 | 0.000 | 0.000 | 0.100 | 0.005 |
| Example | 19 | 0.785 | 0.000 | 0.000 | 0.060 | 0.000 | 0.000 | 0.000 | 0.000 | 0.000 | 0.150 | 0.005 |
| Example | 20 | 0.735 | 0.000 | 0.000 | 0.060 | 0.000 | 0.000 | 0.000 | 0.000 | 0.000 | 0.200 | 0.005 |

| | | $(Fe_{(1-(a+b+c+d+e+f))}M_aB_bSi_cP_dCr_eCu_f)_{1-g}C_g$ ($\alpha = \beta = 0$) | | | | S1 | S2 | | |
|---|---|---|---|---|---|---|---|---|---|
| | Sample No. | P d | Cr e | Cu f | C g | (at %) | (at %) | Bs (T) | Hc (A/m) |
| Example | 16 | 0.000 | 0.000 | 0.000 | 0.005 | 0.25 | 2.35 | 1.75 | 2.8 |
| Example | 17 | 0.000 | 0.000 | 0.000 | 0.005 | 0.21 | 2.45 | 1.71 | 2.7 |
| Example | 18 | 0.000 | 0.000 | 0.000 | 0.005 | 0.18 | 2.47 | 1.63 | 2.6 |
| Example | 19 | 0.000 | 0.000 | 0.000 | 0.005 | 0.19 | 2.26 | 1.55 | 3.0 |
| Example | 20 | 0.000 | 0.000 | 0.000 | 0.005 | 0.17 | 2.35 | 1.43 | 3.8 |

TABLE 4

| | Sample No. | $(Fe_{(1-(a+b+c+d+e+f))}M_aB_bSi_cP_dCr_eCu_f)_{1-g}C_g$ ($\alpha = \beta = 0$) | | | | | | | | | | |
|---|---|---|---|---|---|---|---|---|---|---|---|---|
| | | Fe | Nb | Hf | Zr | Ta | Ti | Mo | V | W | B | Si |
| | | | | | | a | | | | | b | c |
| Example | 21 | 0.870 | 0.000 | 0.000 | 0.030 | 0.000 | 0.000 | 0.000 | 0.000 | 0.000 | 0.090 | 0.010 |
| Example | 22 | 0.830 | 0.000 | 0.000 | 0.070 | 0.000 | 0.000 | 0.000 | 0.000 | 0.000 | 0.090 | 0.010 |
| Example | 24 | 0.905 | 0.000 | 0.000 | 0.060 | 0.000 | 0.000 | 0.000 | 0.000 | 0.000 | 0.025 | 0.010 |
| Example | 25 | 0.730 | 0.000 | 0.000 | 0.060 | 0.000 | 0.000 | 0.000 | 0.000 | 0.000 | 0.200 | 0.010 |
| Example | 26 | 0.855 | 0.000 | 0.000 | 0.030 | 0.000 | 0.000 | 0.000 | 0.000 | 0.000 | 0.090 | 0.025 |
| Example | 27 | 0.815 | 0.000 | 0.000 | 0.070 | 0.000 | 0.000 | 0.000 | 0.000 | 0.000 | 0.090 | 0.025 |
| Example | 29 | 0.890 | 0.000 | 0.000 | 0.060 | 0.000 | 0.000 | 0.000 | 0.000 | 0.000 | 0.025 | 0.025 |
| Example | 30 | 0.715 | 0.000 | 0.000 | 0.060 | 0.000 | 0.000 | 0.000 | 0.000 | 0.000 | 0.200 | 0.025 |

| | Sample No. | $(Fe_{(1-(a+b+c+d+e+f))}M_aB_bSi_cP_dCr_eCu_f)_{1-g}C_g$ ($\alpha = \beta = 0$) | | | | S1 | S2 | | |
|---|---|---|---|---|---|---|---|---|---|
| | | P | Cr | Cu | C | (at | (at | Bs | Hc |
| | | d | e | f | g | %) | %) | (T) | (A/m) |
| Example | 21 | 0.000 | 0.000 | 0.000 | 0.010 | 0.23 | 4.80 | 1.71 | 2.3 |
| Example | 22 | 0.000 | 0.000 | 0.000 | 0.010 | 0.25 | 5.30 | 1.63 | 2.4 |
| Example | 24 | 0.000 | 0.000 | 0.000 | 0.010 | 0.23 | 5.23 | 1.78 | 2.0 |
| Example | 25 | 0.000 | 0.000 | 0.000 | 0.010 | 0.34 | 5.33 | 1.46 | 3.1 |
| Example | 26 | 0.000 | 0.000 | 0.000 | 0.025 | 0.35 | 6.23 | 1.64 | 2.5 |
| Example | 27 | 0.000 | 0.000 | 0.000 | 0.025 | 1.34 | 5.23 | 1.62 | 2.6 |
| Example | 29 | 0.000 | 0.000 | 0.000 | 0.025 | 1.25 | 6.45 | 1.74 | 2.2 |
| Example | 30 | 0.000 | 0.000 | 0.000 | 0.025 | 1.43 | 6.23 | 1.45 | 3.4 |

TABLE 5

| | Sample No. | $(Fe_{(1-(a+b+c+d+e+f))}M_aB_bSi_cP_dCr_eCu_f)_{1-g}C_g$ ($\alpha = \beta = 0$) | | | | | | | | | | |
|---|---|---|---|---|---|---|---|---|---|---|---|---|
| | | Fe | Nb | Hf | Zr | Ta | Ti | Mo | V | W | B | Si |
| | | | | | | a | | | | | b | c |
| Example | 31 | 0.909 | 0.000 | 0.000 | 0.060 | 0.000 | 0.000 | 0.000 | 0.000 | 0.000 | 0.030 | 0.001 |
| Example | 32 | 0.900 | 0.000 | 0.000 | 0.060 | 0.000 | 0.000 | 0.000 | 0.000 | 0.000 | 0.030 | 0.010 |
| Example | 33 | 0.880 | 0.000 | 0.000 | 0.060 | 0.000 | 0.000 | 0.000 | 0.000 | 0.000 | 0.030 | 0.030 |
| Example | 34 | 0.870 | 0.000 | 0.000 | 0.060 | 0.000 | 0.000 | 0.000 | 0.000 | 0.000 | 0.030 | 0.040 |
| Example | 35 | 0.860 | 0.000 | 0.000 | 0.060 | 0.000 | 0.000 | 0.000 | 0.000 | 0.000 | 0.030 | 0.050 |
| Example | 35a | 0.835 | 0.000 | 0.000 | 0.060 | 0.000 | 0.000 | 0.000 | 0.000 | 0.000 | 0.030 | 0.075 |
| Example | 35b | 0.810 | 0.000 | 0.000 | 0.060 | 0.000 | 0.000 | 0.000 | 0.000 | 0.000 | 0.030 | 0.100 |
| Example | 35c | 0.770 | 0.000 | 0.000 | 0.060 | 0.000 | 0.000 | 0.000 | 0.000 | 0.000 | 0.030 | 0.140 |
| Example | 35d | 0.740 | 0.000 | 0.000 | 0.060 | 0.000 | 0.000 | 0.000 | 0.000 | 0.000 | 0.030 | 0.170 |
| Comparative Example | 35e | 0.730 | 0.000 | 0.000 | 0.060 | 0.000 | 0.000 | 0.000 | 0.000 | 0.000 | 0.030 | 0.180 |
| Example | 36 | 0.909 | 0.000 | 0.000 | 0.060 | 0.000 | 0.000 | 0.000 | 0.000 | 0.000 | 0.030 | 0.001 |
| Example | 37 | 0.900 | 0.000 | 0.000 | 0.060 | 0.000 | 0.000 | 0.000 | 0.000 | 0.000 | 0.030 | 0.010 |
| Example | 38 | 0.880 | 0.000 | 0.000 | 0.060 | 0.000 | 0.000 | 0.000 | 0.000 | 0.000 | 0.030 | 0.030 |
| Example | 39 | 0.870 | 0.000 | 0.000 | 0.060 | 0.000 | 0.000 | 0.000 | 0.000 | 0.000 | 0.030 | 0.040 |
| Example | 40 | 0.860 | 0.000 | 0.000 | 0.060 | 0.000 | 0.000 | 0.000 | 0.000 | 0.000 | 0.030 | 0.050 |
| Example | 41 | 0.909 | 0.000 | 0.000 | 0.060 | 0.000 | 0.000 | 0.000 | 0.000 | 0.000 | 0.030 | 0.001 |
| Example | 42 | 0.900 | 0.000 | 0.000 | 0.060 | 0.000 | 0.000 | 0.000 | 0.000 | 0.000 | 0.030 | 0.010 |
| Example | 43 | 0.880 | 0.000 | 0.000 | 0.060 | 0.000 | 0.000 | 0.000 | 0.000 | 0.000 | 0.030 | 0.030 |
| Example | 44 | 0.870 | 0.000 | 0.000 | 0.060 | 0.000 | 0.000 | 0.000 | 0.000 | 0.000 | 0.030 | 0.040 |
| Example | 45 | 0.860 | 0.000 | 0.000 | 0.060 | 0.000 | 0.000 | 0.000 | 0.000 | 0.000 | 0.030 | 0.050 |
| Example | 46 | 0.844 | 0.065 | 0.000 | 0.000 | 0.000 | 0.000 | 0.000 | 0.000 | 0.000 | 0.080 | 0.001 |
| Example | 47 | 0.845 | 0.065 | 0.000 | 0.000 | 0.000 | 0.000 | 0.000 | 0.000 | 0.000 | 0.070 | 0.010 |
| Example | 48 | 0.845 | 0.065 | 0.000 | 0.000 | 0.000 | 0.000 | 0.000 | 0.000 | 0.000 | 0.040 | 0.040 |

| | Sample No. | $(Fe_{(1-(a+b+c+d+e+f))}M_aB_bSi_cP_dCr_eCu_f)_{1-g}C_g$ ($\alpha = \beta = 0$) | | | | S1 | S2 | | |
|---|---|---|---|---|---|---|---|---|---|
| | | P | Cr | Cu | C | (at | (at | Bs | Hc |
| | | d | e | f | g | %) | %) | (T) | (A/m) |
| Example | 31 | 0.000 | 0.000 | 0.000 | 0.000 | 0.12 | 1.78 | 1.72 | 4.8 |
| Example | 32 | 0.000 | 0.000 | 0.000 | 0.000 | 0.21 | 5.21 | 1.73 | 2.4 |
| Example | 33 | 0.000 | 0.000 | 0.000 | 0.000 | 1.23 | 6.98 | 1.68 | 2.6 |
| Example | 34 | 0.000 | 0.000 | 0.000 | 0.000 | 3.98 | 7.45 | 1.69 | 3.2 |
| Example | 35 | 0.000 | 0.000 | 0.000 | 0.000 | 4.21 | 7.83 | 1.58 | 4.8 |
| Example | 35a | 0.000 | 0.000 | 0.000 | 0.000 | 5.6 | 8.9 | 1.50 | 4.8 |
| Example | 35b | 0.000 | 0.000 | 0.000 | 0.000 | 9.4 | 11.3 | 1.48 | 4.6 |
| Example | 35c | 0.000 | 0.000 | 0.000 | 0.000 | 13.6 | 14.5 | 1.45 | 3.5 |
| Example | 35d | 0.000 | 0.000 | 0.000 | 0.000 | 16.9 | 17.4 | 1.42 | 2.4 |

TABLE 5-continued

| | | | | | | | | | |
|---|---|---|---|---|---|---|---|---|---|
| Comparative Example | 35e | 0.000 | 0.000 | 0.000 | 0.000 | 19.4 | 17.2 | 1.33 | 3.3 |
| Example | 36 | 0.000 | 0.000 | 0.000 | 0.010 | 0.12 | 1.78 | 1.75 | 5.8 |
| Example | 37 | 0.000 | 0.000 | 0.000 | 0.010 | 0.21 | 5.21 | 1.73 | 2.1 |
| Example | 38 | 0.000 | 0.000 | 0.000 | 0.010 | 1.23 | 6.98 | 1.72 | 2.4 |
| Example | 39 | 0.000 | 0.000 | 0.000 | 0.010 | 3.98 | 7.45 | 1.65 | 3.0 |
| Example | 40 | 0.000 | 0.000 | 0.000 | 0.010 | 4.21 | 7.83 | 1.65 | 4.5 |
| Example | 41 | 0.000 | 0.000 | 0.000 | 0.030 | 0.23 | 1.84 | 1.65 | 5.9 |
| Example | 42 | 0.000 | 0.000 | 0.000 | 0.030 | 0.24 | 5.32 | 1.54 | 4.8 |
| Example | 43 | 0.000 | 0.000 | 0.000 | 0.030 | 1.45 | 6.98 | 1.57 | 4.9 |
| Example | 44 | 0.000 | 0.000 | 0.000 | 0.030 | 2.99 | 7.23 | 1.51 | 5.2 |
| Example | 45 | 0.000 | 0.000 | 0.000 | 0.030 | 4.12 | 7.34 | 1.52 | 5.3 |
| Example | 46 | 0.010 | 0.000 | 0.000 | 0.000 | 0.10 | 1.81 | 1.62 | 2.1 |
| Example | 47 | 0.010 | 0.000 | 0.000 | 0.000 | 0.22 | 5.21 | 1.61 | 2.5 |
| Example | 48 | 0.010 | 0.000 | 0.000 | 0.000 | 1.23 | 7.32 | 1.63 | 2.4 |

TABLE 6

| | | $(Fe_{(1-(a+b+c+d+e+f))}M_aB_bSi_cP_dCr_eCu_f)_{1-g}C_g$ ($\alpha = \beta = 0$) | | | | | | | | | |
|---|---|---|---|---|---|---|---|---|---|---|---|
| | Sample No. | Fe | Nb | Hf | Zr | Ta | Ti | Mo | V | W | B |
| | | | | | | a | | | | | b |
| Example | 49 | 0.875 | 0.030 | 0.000 | 0.000 | 0.000 | 0.000 | 0.000 | 0.000 | 0.000 | 0.090 |
| Example | 50 | 0.875 | 0.000 | 0.030 | 0.000 | 0.000 | 0.000 | 0.000 | 0.000 | 0.000 | 0.090 |
| Example | 9 | 0.875 | 0.000 | 0.000 | 0.030 | 0.000 | 0.000 | 0.000 | 0.000 | 0.000 | 0.090 |
| Example | 51 | 0.875 | 0.000 | 0.000 | 0.000 | 0.030 | 0.000 | 0.000 | 0.000 | 0.000 | 0.090 |
| Example | 52 | 0.875 | 0.000 | 0.000 | 0.000 | 0.000 | 0.030 | 0.000 | 0.000 | 0.000 | 0.090 |
| Example | 53 | 0.875 | 0.000 | 0.000 | 0.000 | 0.000 | 0.000 | 0.030 | 0.000 | 0.000 | 0.090 |
| Example | 54 | 0.875 | 0.000 | 0.000 | 0.000 | 0.000 | 0.000 | 0.000 | 0.030 | 0.000 | 0.090 |
| Example | 55 | 0.875 | 0.000 | 0.000 | 0.000 | 0.000 | 0.000 | 0.000 | 0.000 | 0.030 | 0.090 |

| | | $(Fe_{(1-(a+b+c+d+e+f))}M_aB_bSi_cP_dCr_eCu_f)_{1-g}C_g$ ($\alpha = \beta = 0$) | | | | | | S2 | | Hc |
|---|---|---|---|---|---|---|---|---|---|---|
| | Sample No. | Si c | P d | Cr e | Cu f | C g | S1 (at %) | (at %) | Bs (T) | (A/m) |
| Example | 49 | 0.005 | 0.000 | 0.000 | 0.000 | 0.005 | 0.25 | 2.35 | 1.69 | 2.5 |
| Example | 50 | 0.005 | 0.000 | 0.000 | 0.000 | 0.005 | 0.22 | 2.43 | 1.69 | 2.3 |
| Example | 9 | 0.005 | 0.000 | 0.000 | 0.000 | 0.005 | 0.20 | 2.34 | 1.70 | 2.8 |
| Example | 51 | 0.005 | 0.000 | 0.000 | 0.000 | 0.005 | 0.12 | 2.45 | 1.55 | 3.0 |
| Example | 52 | 0.005 | 0.000 | 0.000 | 0.000 | 0.005 | 0.13 | 2.46 | 1.62 | 2.8 |
| Example | 53 | 0.005 | 0.000 | 0.000 | 0.000 | 0.005 | 0.21 | 2.45 | 1.58 | 2.4 |
| Example | 54 | 0.005 | 0.000 | 0.000 | 0.000 | 0.005 | 0.21 | 2.43 | 1.52 | 2.8 |
| Example | 55 | 0.005 | 0.000 | 0.000 | 0.000 | 0.005 | 0.24 | 2.46 | 1.52 | 2.9 |

TABLE 7

| | | $(Fe_{(1-(a+b+c+d+e+f))}M_aB_bSi_cP_dCr_eCu_f)_{1-g}C_g$ ($\alpha = \beta = 0$) | | | | | | | | | |
|---|---|---|---|---|---|---|---|---|---|---|---|
| | Sample No. | Fe | Nb | Hf | Zr | Ta | Ti | Mo | V | W | B |
| | | | | | | a | | | | | b |
| Example | 56 | 0.875 | 0.015 | 0.015 | 0.000 | 0.000 | 0.000 | 0.000 | 0.000 | 0.000 | 0.090 |
| Example | 57 | 0.875 | 0.000 | 0.015 | 0.015 | 0.000 | 0.000 | 0.000 | 0.000 | 0.000 | 0.090 |
| Example | 58 | 0.875 | 0.015 | 0.000 | 0.015 | 0.000 | 0.000 | 0.000 | 0.000 | 0.000 | 0.090 |
| Example | 59 | 0.875 | 0.000 | 0.000 | 0.015 | 0.015 | 0.000 | 0.000 | 0.000 | 0.000 | 0.090 |
| Example | 60 | 0.875 | 0.000 | 0.000 | 0.015 | 0.000 | 0.015 | 0.000 | 0.000 | 0.000 | 0.090 |
| Example | 61 | 0.875 | 0.000 | 0.000 | 0.015 | 0.000 | 0.000 | 0.015 | 0.000 | 0.000 | 0.090 |
| Example | 62 | 0.875 | 0.000 | 0.000 | 0.015 | 0.000 | 0.000 | 0.000 | 0.015 | 0.000 | 0.090 |
| Example | 63 | 0.875 | 0.000 | 0.000 | 0.015 | 0.000 | 0.000 | 0.000 | 0.000 | 0.015 | 0.090 |

| | | $(Fe_{(1-(a+b+c+d+e+f))}M_aB_bSi_cP_dCr_eCu_f)_{1-g}C_g$ ($\alpha = \beta = 0$) | | | | | | S2 | | Hc |
|---|---|---|---|---|---|---|---|---|---|---|
| | Sample No. | Si c | P d | Cr e | Cu f | C g | S1 (at %) | (at %) | Bs (T) | (A/m) |
| Example | 56 | 0.005 | 0.000 | 0.000 | 0.000 | 0.005 | 0.22 | 2.44 | 1.66 | 2.4 |
| Example | 57 | 0.005 | 0.000 | 0.000 | 0.000 | 0.005 | 0.21 | 2.34 | 1.72 | 2.4 |

TABLE 7-continued

| | | | | | | | | | | |
|---|---|---|---|---|---|---|---|---|---|---|
| Example | 58 | 0.005 | 0.000 | 0.000 | 0.000 | 0.005 | 0.11 | 2.46 | 1.68 | 2.3 |
| Example | 59 | 0.005 | 0.000 | 0.000 | 0.000 | 0.005 | 0.13 | 2.45 | 1.50 | 2.4 |
| Example | 60 | 0.005 | 0.000 | 0.000 | 0.000 | 0.005 | 0.24 | 2.54 | 1.51 | 2.5 |
| Example | 61 | 0.005 | 0.000 | 0.000 | 0.000 | 0.005 | 0.11 | 2.87 | 1.52 | 2.7 |
| Example | 62 | 0.005 | 0.000 | 0.000 | 0.000 | 0.005 | 0.15 | 2.48 | 1.48 | 2.9 |
| Example | 63 | 0.005 | 0.000 | 0.000 | 0.000 | 0.005 | 0.13 | 2.46 | 1.48 | 3.1 |

TABLE 8

| | | $(Fe_{(1-(a+b+c+d+e+f))}M_aB_bSi_cP_dCr_eCu_f)_{1-g}C_g$ ($\alpha = \beta = 0$) | | | | | | | | | |
|---|---|---|---|---|---|---|---|---|---|---|---|
| | Sample No. | Fe | Nb | Hf | Zr | Ta | Ti | Mo | V | W | B |
| | | | | | | a | | | | | b |
| Example | 64 | 0.875 | 0.010 | 0.010 | 0.010 | 0.000 | 0.000 | 0.000 | 0.000 | 0.000 | 0.090 |
| Example | 66 | 0.815 | 0.030 | 0.000 | 0.030 | 0.030 | 0.000 | 0.000 | 0.000 | 0.000 | 0.090 |
| Example | 67 | 0.815 | 0.030 | 0.000 | 0.030 | 0.000 | 0.030 | 0.000 | 0.000 | 0.000 | 0.090 |
| Example | 68 | 0.815 | 0.030 | 0.000 | 0.030 | 0.000 | 0.000 | 0.030 | 0.000 | 0.000 | 0.090 |
| Example | 69 | 0.815 | 0.030 | 0.000 | 0.030 | 0.000 | 0.000 | 0.000 | 0.030 | 0.000 | 0.090 |
| Example | 70 | 0.815 | 0.030 | 0.000 | 0.030 | 0.000 | 0.000 | 0.000 | 0.000 | 0.030 | 0.090 |

| | | $(Fe_{(1-(a+b+c+d+e+f))}M_aB_bSi_cP_dCr_eCu_f)_{1-g}C_g$ ($\alpha = \beta = 0$) | | | | | | S2 | | Hc |
|---|---|---|---|---|---|---|---|---|---|---|
| | Sample No. | Si c | P d | Cr e | Cu f | C g | S1 (at %) | (at %) | Bs (T) | (A/m) |
| Example | 64 | 0.005 | 0.000 | 0.000 | 0.000 | 0.005 | 0.11 | 2.47 | 1.72 | 2.5 |
| Example | 66 | 0.005 | 0.000 | 0.000 | 0.000 | 0.005 | 0.24 | 2.65 | 1.64 | 2.8 |
| Example | 67 | 0.005 | 0.000 | 0.000 | 0.000 | 0.005 | 0.11 | 2.65 | 1.68 | 2.5 |
| Example | 68 | 0.005 | 0.000 | 0.000 | 0.000 | 0.005 | 0.16 | 2.43 | 1.62 | 2.5 |
| Example | 69 | 0.005 | 0.000 | 0.000 | 0.000 | 0.005 | 0.15 | 2.67 | 1.63 | 2.6 |
| Example | 70 | 0.005 | 0.000 | 0.000 | 0.000 | 0.005 | 0.16 | 2.54 | 1.65 | 2.6 |

TABLE 9

| | | $(Fe_{(1-(a+b+c+d+e+f))}M_aB_bSi_cP_dCr_eCu_f)_{1-g}C_g$ ($\alpha = \beta = 0$) | | | | | | | | | |
|---|---|---|---|---|---|---|---|---|---|---|---|
| | Sample No. | Fe | Nb | Hf | Zr | Ta | Ti | Mo | V | W | B |
| | | | | | | a | | | | | b |
| Example | 71 | 0.819 | 0.070 | 0.000 | 0.000 | 0.000 | 0.000 | 0.000 | 0.000 | 0.000 | 0.100 |
| Example | 72 | 0.815 | 0.070 | 0.000 | 0.000 | 0.000 | 0.000 | 0.000 | 0.000 | 0.000 | 0.100 |
| Example | 73 | 0.810 | 0.070 | 0.000 | 0.000 | 0.000 | 0.000 | 0.000 | 0.000 | 0.000 | 0.100 |
| Example | 74 | 0.805 | 0.070 | 0.000 | 0.000 | 0.000 | 0.000 | 0.000 | 0.000 | 0.000 | 0.100 |
| Example | 75 | 0.800 | 0.070 | 0.000 | 0.000 | 0.000 | 0.000 | 0.000 | 0.000 | 0.000 | 0.100 |
| Example | 76 | 0.790 | 0.070 | 0.000 | 0.000 | 0.000 | 0.000 | 0.000 | 0.000 | 0.000 | 0.100 |
| Example | 77 | 0.809 | 0.070 | 0.000 | 0.000 | 0.000 | 0.000 | 0.000 | 0.000 | 0.000 | 0.100 |
| Example | 78 | 0.805 | 0.070 | 0.000 | 0.000 | 0.000 | 0.000 | 0.000 | 0.000 | 0.000 | 0.100 |
| Example | 79 | 0.800 | 0.070 | 0.000 | 0.000 | 0.000 | 0.000 | 0.000 | 0.000 | 0.000 | 0.100 |
| Example | 80 | 0.790 | 0.070 | 0.000 | 0.000 | 0.000 | 0.000 | 0.000 | 0.000 | 0.000 | 0.100 |
| Example | 81 | 0.780 | 0.070 | 0.000 | 0.000 | 0.000 | 0.000 | 0.000 | 0.000 | 0.000 | 0.100 |
| Example | 81a | 0.760 | 0.070 | 0.000 | 0.000 | 0.000 | 0.000 | 0.000 | 0.000 | 0.000 | 0.100 |
| Example | 81b | 0.760 | 0.070 | 0.000 | 0.000 | 0.000 | 0.000 | 0.000 | 0.000 | 0.000 | 0.075 |
| Example | 81c | 0.760 | 0.070 | 0.000 | 0.000 | 0.000 | 0.000 | 0.000 | 0.000 | 0.000 | 0.050 |
| Example | 81d | 0.760 | 0.070 | 0.000 | 0.000 | 0.000 | 0.000 | 0.000 | 0.000 | 0.000 | 0.025 |
| Example | 81e | 0.760 | 0.070 | 0.000 | 0.000 | 0.000 | 0.000 | 0.000 | 0.000 | 0.000 | 0.000 |
| Example | 82 | 0.710 | 0.110 | 0.000 | 0.000 | 0.000 | 0.000 | 0.000 | 0.000 | 0.000 | 0.140 |
| Example | 83 | 0.720 | 0.100 | 0.000 | 0.000 | 0.000 | 0.000 | 0.000 | 0.000 | 0.000 | 0.140 |
| Example | 84 | 0.890 | 0.050 | 0.000 | 0.000 | 0.000 | 0.000 | 0.000 | 0.000 | 0.000 | 0.035 |
| Example | 85 | 0.900 | 0.045 | 0.000 | 0.000 | 0.000 | 0.000 | 0.000 | 0.000 | 0.000 | 0.030 |

| | | $(Fe_{(1-(a+b+c+d+e+f))}M_aB_bSi_cP_dCr_eCu_f)_{1-g}C_g$ ($\alpha = \beta = 0$) | | | | | | S2 | | Hc |
|---|---|---|---|---|---|---|---|---|---|---|
| | Sample No. | Si c | P d | Cr e | Cu f | C g | S1 (at %) | (at %) | Bs (T) | (A/m) |
| Example | 71 | 0.010 | 0.000 | 0.000 | 0.001 | 0.010 | 0.23 | 3.21 | 1.58 | 1.4 |
| Example | 72 | 0.010 | 0.000 | 0.000 | 0.005 | 0.010 | 0.24 | 3.42 | 1.57 | 1.3 |
| Example | 73 | 0.010 | 0.000 | 0.000 | 0.010 | 0.010 | 0.22 | 3.52 | 1.55 | 1.2 |

TABLE 9-continued

| | | | | | | | | | | |
|---|---|---|---|---|---|---|---|---|---|---|
| Example | 74 | 0.010 | 0.000 | 0.000 | 0.015 | 0.010 | 0.26 | 3.45 | 1.53 | 1.5 |
| Example | 75 | 0.010 | 0.000 | 0.000 | 0.020 | 0.010 | 0.28 | 3.25 | 1.52 | 1.9 |
| Example | 76 | 0.010 | 0.000 | 0.000 | 0.030 | 0.010 | 0.25 | 3.45 | 1.48 | 2.1 |
| Example | 77 | 0.010 | 0.001 | 0.000 | 0.010 | 0.010 | 0.21 | 3.66 | 1.51 | 1.3 |
| Example | 78 | 0.010 | 0.005 | 0.000 | 0.010 | 0.010 | 0.25 | 3.56 | 1.53 | 1.4 |
| Example | 79 | 0.010 | 0.010 | 0.000 | 0.010 | 0.010 | 0.26 | 3.32 | 1.56 | 1.3 |
| Example | 80 | 0.010 | 0.020 | 0.000 | 0.010 | 0.010 | 0.28 | 3.67 | 1.52 | 1.3 |
| Example | 81 | 0.010 | 0.030 | 0.000 | 0.010 | 0.010 | 0.23 | 3.56 | 1.48 | 1.5 |
| Example | 81a | 0.010 | 0.050 | 0.000 | 0.010 | 0.010 | 0.21 | 3.76 | 1.43 | 2.1 |
| Example | 81b | 0.010 | 0.075 | 0.000 | 0.010 | 0.010 | 0.18 | 3.88 | 1.44 | 1.9 |
| Example | 81c | 0 010 | 0.100 | 0.000 | 0.010 | 0.010 | 0.15 | 4.08 | 1.43 | 2.3 |
| Example | 81d | 0.010 | 0.125 | 0.000 | 0.010 | 0.010 | 0.08 | 4.11 | 1.45 | 2.2 |
| Example | 81e | 0.010 | 0.150 | 0.000 | 0.010 | 0.010 | 0.04 | 4.21 | 1.43 | 2.3 |
| Example | 82 | 0.010 | 0.000 | 0.010 | 0.020 | 0.000 | 0.26 | 3.21 | 1.40 | 2.2 |
| Example | 83 | 0.010 | 0.000 | 0.010 | 0.020 | 0.000 | 0.25 | 3.66 | 1.43 | 2.1 |
| Example | 84 | 0.010 | 0.000 | 0.005 | 0.010 | 0.000 | 0.26 | 3.67 | 1.69 | 2.1 |
| Example | 85 | 0.010 | 0.000 | 0.005 | 0.010 | 0.000 | 0.23 | 3.54 | 1.70 | 2.7 |

TABLE 10

| | | $Fe_{(1-(a+b))}X1_{\alpha}X2_{\beta}$ (a to g are same as Example 32) | | | | | | | |
|---|---|---|---|---|---|---|---|---|---|
| | | X1 | | X2 | | S1 | S2 | Bs | Hc |
| | Sample No. | Type | α | Type | β | (at %) | (at %) | (T) | (A/m) |
| Example | 32 | — | 0.000 | — | 0.000 | 0.21 | 5.21 | 1.73 | 2.4 |
| Example | 86 | Co | 0.010 | — | 0.000 | 0.25 | 5.31 | 1.73 | 2.4 |
| Example | 87 | Co | 0.100 | — | 0.000 | 0.26 | 5.64 | 1.74 | 2.4 |
| Example | 88 | Co | 0.400 | — | 0.000 | 0.23 | 5.34 | 1.75 | 2.4 |
| Example | 89 | Ni | 0.010 | — | 0.000 | 0.21 | 5.23 | 1.72 | 2.3 |
| Example | 90 | Ni | 0.100 | — | 0.000 | 0.22 | 5.21 | 1.70 | 2.4 |
| Example | 91 | Ni | 0.400 | — | 0.000 | 0.27 | 5.34 | 1.68 | 2.1 |
| Example | 92 | — | 0.000 | Al | 0.030 | 0.26 | 5.44 | 1.70 | 2.1 |
| Example | 93 | — | 0.000 | Mn | 0.030 | 0.21 | 5.32 | 1.70 | 2.1 |
| Example | 94 | — | 0.000 | Zn | 0.030 | 0.22 | 5.23 | 1.71 | 2.3 |
| Example | 95 | — | 0.000 | Sn | 0.030 | 0.24 | 5.33 | 1.75 | 2.4 |
| Example | 96 | — | 0.000 | Bi | 0.030 | 0.22 | 5.34 | 1.75 | 2.7 |
| Example | 97 | — | 0.000 | Y | 0.030 | 0.21 | 5.44 | 1.79 | 5.2 |
| Example | 98 | — | 0.000 | La | 0.030 | 0.14 | 5.32 | 1.73 | 4.8 |
| Example | 99 | — | 0.000 | Ce | 0.030 | 0.11 | 5.41 | 1.74 | 3.9 |
| Example | 100 | — | 0.000 | Dy | 0.030 | 0.23 | 5.32 | 1.69 | 6.9 |
| Example | 101 | — | 0.000 | Nd | 0.030 | 0.21 | 5.32 | 1.75 | 6.8 |
| Example | 102 | — | 0.000 | Gd | 0.030 | 0.23 | 5.21 | 1.73 | 2.6 |
| Example | 102a | — | 0.000 | S | 0.030 | 0.13 | 5.22 | 1.65 | 2.4 |
| Example | 103 | Co | 0.100 | Al | 0.030 | 0.12 | 5.21 | 1.73 | 2.1 |

It has been confirmed that the soft magnetic alloys in all Examples above are composed of a Fe-based nanocrystal and an amorphous phase and S1−S2>0 in the soft magnetic alloys. Furthermore, the average grain size of the Fe-based nanocrystals was measured, and it has been confirmed that the average grain size of the Fe-based nanocrystals is 5.0 nm or more and 30 nm or less in all Examples and Comparative Examples.

Table 2 describes Examples in which the M content (a) is changed. In the respective Examples in which $0 \leq a \leq 0.14$ was satisfied, the saturation magnetic flux density and the coercivity were favorable.

Table 3 describes Examples in which the B content (b) is changed. In the respective Examples in which $0 \leq b \leq 0.20$ was satisfied, the saturation magnetic flux density and the coercivity were favorable.

Table 4 describes Examples in which the M content (a) or the B content (b) is changed in the range of the present invention and further the Si content (c) and the C content (g) are simultaneously changed. In Examples in which the content of each component was in a predetermined range, the saturation magnetic flux density and the coercivity were favorable.

Table 5 describes Examples in which the Si content (c) and/or the C content (g) are changed. In Examples in which the content of each component was in a predetermined range, the saturation magnetic flux density and the coercivity were favorable.

Table 6 describes Examples in which the kind of M is changed from that in Example 9. In Examples in which the content of each component was in a predetermined range even though the kind of M was changed, the saturation magnetic flux density and the coercivity were favorable. The saturation magnetic flux density tended to be improved particularly in the case of using Nb, Hf or Zr.

Table 7 describes Examples in which two kinds of elements are used as M. In Examples in which the content of each component was in a predetermined range even though the kind of M was changed, the saturation magnetic flux density and the coercivity were favorable. The saturation magnetic flux density tended to be improved particularly in the case of using two kinds of elements selected from Nb, Hf or Zr.

Table 8 describes Examples in which three kinds of elements are used as M. In Examples in which the content of each component was in a predetermined range even though the kind of M was changed, the saturation magnetic flux density and the coercivity were favorable. The saturation magnetic flux density tended to be improved particularly in a case in which two or more kinds of elements were selected from Nb, Hf or Zr and used and the proportion of Nb, Hf and Zr in the entire M exceeds 50 at %.

Examples 71 to 81 in Table 9 describe Examples in which the P content (d) or the Cu content (f) is changed. Examples 81a to 81e in Table 9 are Examples in which the B content (B) is further changed in addition to the P content (d). In Examples 82 to 85 in Table 9, the Cr content (e) is changed and, at the same time, the M content (a), the B content (b) and/or the Cu content (f) were changed. In Examples in which the content of each component was in a predetermined range, the saturation magnetic flux density and the coercivity were favorable.

Table 10 describes Examples in which a part of Fe was substituted with X1 and/or X2 in Example 28. Favorable properties were exhibited even when a part of Fe was substituted with X1 and/or X2.

The invention claimed is:

1. A soft magnetic alloy comprising Fe as a main component and Si, wherein the soft magnetic alloy comprises a Fe-based nanocrystal and an amorphous phase, S2−S1>0 is satisfied, where S1 (at %) denotes an average content rate of Si in the Fe-based nanocrystal and S2 (at %) denotes an average content rate of Si in the amorphous phase, and the soft magnetic alloy has a composition formula of $((Fe_{(1-(\alpha+\beta))}X1_{\alpha}X2_{\beta})_{(1-(a+b+c+d+e+f))}M_aB_bSi_cP_dCr_eCu_f)_{1-g}C_g$, wherein X1 is one or more selected from the group consisting of Co and Ni, X2 is one or more selected from the group consisting of Al, Mn, Ag, Zn, Sn, As, Sb, Bi, N, O, S and a rare earth element, M is one or more selected from the group consisting of Nb, Hf, Zr, Ta, Ti, Mo, V and W, and $0 \le a \le 0.14$ $0 \le b \le 0.20$ $0 < c \le 0.17$ $0 \le d \le 0.15$ $0 \le e \le 0.040$ $0 \le f \le 0.030$ $0 \le g < 0.030$ $0 \le \alpha\{1-(a+b+c+d+e+f)\}(1-g) \le 0.40$ $0 \le \beta\{1-(a+b+c+d+e+f)\}(1-g) \le 0.030$ $0 \le \alpha+\beta \le 0.50$.

2. The soft magnetic alloy according to claim 1, wherein S2−S1≥2.00 is satisfied.

3. The soft magnetic alloy according to claim 2, wherein the soft magnetic alloy is formed in a ribbon form.

4. The soft magnetic alloy according to claim 2, wherein the soft magnetic alloy is formed in a powder form.

5. A magnetic device comprising the soft magnetic alloy according to claim 2.

6. The soft magnetic alloy according to claim 1, wherein an average grain size of the Fe-based nanocrystals is 5.0 nm or more and 30 nm or less.

7. The soft magnetic alloy according to claim 6, wherein the soft magnetic alloy is formed in a ribbon form.

8. The soft magnetic alloy according to claim 2, wherein the soft magnetic alloy is formed in a powder form.

9. A magnetic device comprising the soft magnetic alloy according to claim 6.

10. The soft magnetic alloy according to claim 1, wherein $0.73 \le 1-(a+b+c+d+e+f) \le 0.95$ is satisfied.

11. The soft magnetic alloy according to claim 1, wherein $\alpha=0$ is satisfied.

12. The soft magnetic alloy according to claim 1, wherein $\beta=0$ is satisfied.

13. The soft magnetic alloy according to claim 1, wherein $\alpha=\beta=0$ is satisfied.

14. The soft magnetic alloy according to claim 1, wherein the soft magnetic alloy is formed in a ribbon form.

15. The soft magnetic alloy according to claim 1, wherein the soft magnetic alloy is formed in a powder form.

16. A manetic device comprising the soft magnetic alloy according to claim 1.

* * * * *